United States Patent [19]

Hashimoto et al.

[11] 4,393,670

[45] Jul. 19, 1983

[54] AUTOMATIC KNITTING NEEDLE SELECTION DEVICE

[75] Inventors: Takeji Hashimoto, Nagaokakyo; Kiyohumi Okumoto; Masayasu Andoh, both of Kyoto, all of Japan

[73] Assignee: Dainippon Screen Seizo Kabushiki Kaisha, Japan

[21] Appl. No.: 289,258

[22] Filed: Aug. 3, 1981

[30] Foreign Application Priority Data

Aug. 20, 1980 [JP] Japan ..... 55-113421

[51] Int. Cl.[3] ..... D04B 7/00; D04B 15/66

[52] U.S. Cl. ..... 66/75.2

[58] Field of Search ..... 66/75.2, 231, 232, 218, 66/221

[56] References Cited

U.S. PATENT DOCUMENTS

| | | | |
|---|---|---|---|
| 2,153,342 | 4/1939 | Ruinnett | 66/75 |
| 3,370,443 | 2/1968 | Bentley et al. | 66/23 L |
| 4,222,247 | 9/1980 | Hashimoto et al. | 66/75.2 |
| 4,275,573 | 6/1981 | Hashimoto et al. | 66/75.2 |

*Primary Examiner*—Ronald Feldbaum

[57] ABSTRACT

An automatic knitting needle selection device in which a plurality of selectors are provided with protrusions which are normally in contact with corresponding solenoids that are mounted on a swing plate. The selectors are pivotally connected to a pivot shaft at their lower ends and the tilting motion of the swing plate puts the selectors corresponding to energized solenoids out of action while the remaining selectors are pushed upward by another drive means to set the corresponding knitting needles to a knitting position.

12 Claims, 6 Drawing Figures

AUTOMATIC KNITTING NEEDLE SELECTION DEVICE

This invention relates to flat knitting machines, warp knitting machines and jacquard machines, and in particular to an automatic knitting needle selection mechanism for forming knitting patterns in a knitting machine.

In coventional flat knitting machines, warp knitting machines and jacquard machines, the setup of the needle arrangement for each particular knitting pattern has heretofore been mechanically performed by means of punched card or the like. The manual preparation of these punched cards from drawn pattern designs has required a large amount of time and cost.

Recently, after machines for preparing punched cards from video signals obtained by photoelectrically scanning an original picture have become available, considerable improvements have been made in the way of speed and accuracy in the preparation of punched cards for desired knitting patterns. However, when the knitting pattern is to be changed, the whole punched card deck has to be replaced and it is practically impossible to partially modify the knitting pattern.

We have therefore conceived an idea for eliminating the above mentioned shortcomings of conventional knitting machines using video signals obtained directly or via magnetic tape by photoelectrically scanning an original knitting pattern design. However, there were certain difficulties that are to be overcome in order to build a useful machine.

First of all, since the width of the smallest solenoid is far greater than the distance between each two selectors in a knitting machine—which is typically 1.5 to 2.0 mm—, the solenoids will not fit in the available space if they are simply arranged in a row.

Secondly, if the solenoids are all fixed, it is very difficult to attract only desired selectors by selectively activating the solenoids since the neighboring selectors tend to be attracted or affected from stray magnetic flux, causing mis-operation sometimes.

Thirdly, if the selectors are to be attracted by solenoids over a certain distance as in conventional knitting machines, a large amplitude of electric power has to be supplied to each of the energized solenoids. When the number of solenoids that have to be energized at any particular moment is great, the power consumption becomes considerably great.

In view of such inconvenience of conventional knitting machines, an improved automatic needle selection mechanism has been disclosed in Japanese Patent Application No. 54-23638 (U.S. Pat. No. 4,275,573 issued on June 30, 1981). The needle selection mechanism comprises a plurality of vertically oriented selectors for pushing knitting needles, a movable mounting plate on which the same number of solenoids as the number of the selectors are mounted and which can be tilted back and forth for pulling forward those selectors corresponding to the energized solenoids to put them out of action in pushing up the knitting needles into a knit position.

The selectors corresponding to the energized solenoids are disengaged from a selector bed which undergoes the vertical motion for pushing up the selectors engaged thereto for putting the corresponding knitting needles to the knit position. Thus, since the movable mounting plate is tilted backward, the solenoids are always closely contacted to the selectors when they are energized and pulling forward the selectors corresponding to the energized solenoids.

The needle selection mechanism described above is generally satisfactory for attaining the above described objects. However, it was found that since the selectors are merely hooked on a rib or a step protruding from the selector bed, it was possible that the selectors could be inadvertently disengaged from the selector bed primarily owing to the vibrations of the knitting machine to which the needle selection mechanism is applied. This could be prevented through proper designing but still make up a disadvantage in restricting the freedom of design.

In view of the shortcoming of the above mentioned invention, the primary object of this invention is to more securely attach the selectors to the selector bed so as not to be easily disengaged therefrom for eliminating the chance of the occurence of mis-operation, without sacrificing the maximum working speed of the knitting machine.

Such an object is accomplished, according to this invention by providing a knitting needle selection mechanism for forming knitting patterns in a knitting machine, comprising a plurality of vertically oriented knitting needles which can assume either a knit position or a non-knit position, a plurality of vertically oriented selectors, provided in one-to-one relation with respect to the knitting needles and pivoted at their lower ends by a pivot shaft, which can assume either a first position adapted for moving the corresponding knitting needles from the non-knit position to the knit position and a second position adapted for not moving the corresponding knitting needles from the non-knit position to the knit position, a plurality of solenoids, again provided in one-to-one relation relative to the selectors, for attracting a selected group from the selectors according to a desired knitting pattern, a first drive means for moving the selectors other than those in the selected group from the first position to the second position, and a second drive means for moving the selectors other than those belonging to the selected group so as to move the corresponding knitting needles from the non-knit position to the knit position.

Now, the present invention is described in what follows with respect to its preferred embodiment making reference to the attached drawings. In the drawings.

Figure 1:
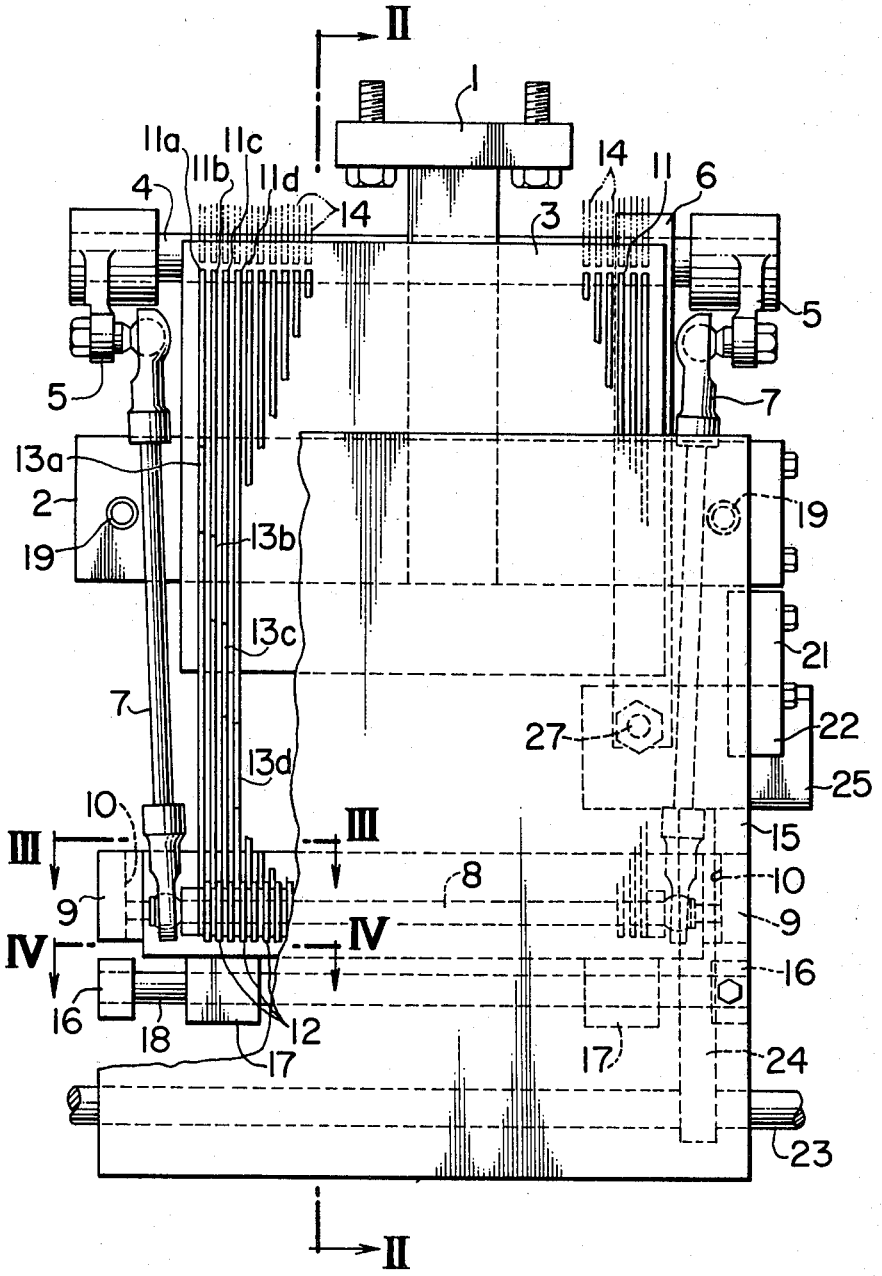
FIG. 1 is a front view of the knitting needle selection device according to this invention.
Figure 2:
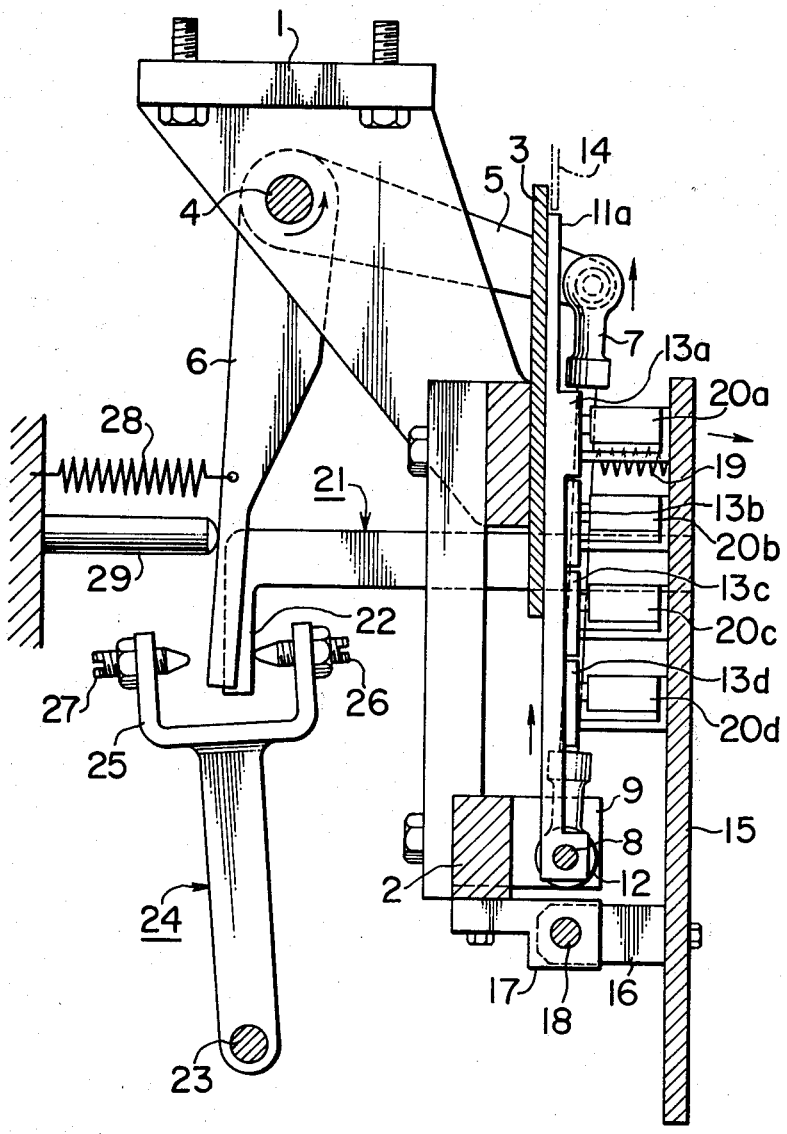
FIG. 2 is a cross sectional view taken along line II—II of FIG. 1.

As shown FIGS. 1 and 2, a vertically oriented selector bed 3 is fixed on the upper front surface of a base frame 2 which is in turn secured to the forwardly projecting free end of a mounting bracket 1.

A forwardly extending horizontal arm 5 is secured to each side end of a first pivot shaft 4 which is pivotally mounted on the mounting bracket 1 horizontally and substantially perpendicular to the forwardly extending arm of the mounting bracket 1. A vertical arm 6 is also secured to the pivot shaft 4 slightly inwardly of the horizontal arm 5 on the right hand side in the sense of FIG. 1. Since both the two horizontal arms 5 and the vertical arm 6 are secured to the same pivot shaft 4, these arms move integrally to one another.

To the front end of each of the horizontal arms 5 is pivoted the upper end of a downwardly extending elevator arm 7, and the bottom ends of the elevator arms 7 are also pivotally connected to the two side ends of a second pivot shaft 8.

Each of the mutually opposing surfaces of the shoulders 9 projecting forwardly from the both side ends of the lower end of the front surface of the base frame 2 is provided with a vertically extending slot 10. The both lateral ends of the second pivot axis 8 are engaged within the slots 10 so as to be only capable of vertical motion guided by these slots 10.

Figure 3:
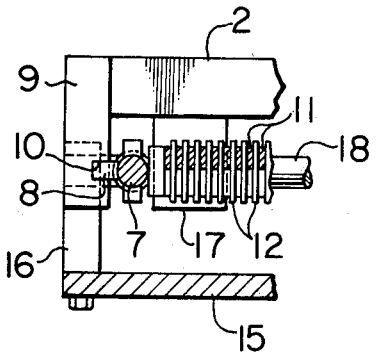
FIG. 3 is a cross sectional view taken along line III—III of FIG. 1.

The lower ends of a plurality of selectors 11 are pivotally fit onto the second pivot shaft 8 alternatingly with spacers 12 of a certain thickness as clearly shown in FIG. 3. FIG. 3 also shows the second pivot shaft 8 engaged within the groove 10 at each of its two side ends.

The selectors 11 are made of vertically extending metal plates with a relatively small width and, since the center of gravity of these selectors is located slightly rear to the second pivot shaft 8 on which each of the selectors are pivotally and freely standing, the selectors 11 are biased rearwardly and lean against the front surface of the selector bed 3 under the force of gravity.

And, the selectors 11*a*, 11*b*, 11*c* and 11*d* are provided with projections 13*a*, 13*b*, 13*c* and 13*d* so that the projections are staggered from one another with their height decreasing from left to right for each set of selectors consisting of four. And, the lower end of a knitting needle 14 is located slightly above the upper end of each of the selectors 11. Therefore, upward motion of a selector 11 will normally place the corresponding knitting needle 14 into a knit position.

Forwardly of the selectors 11 is disposed a swing plate 15, substantially parallel to the selector bed 3, with the support arms 16 projecting rearwardly from the two side ends of the lower end of the swing plate 15 and pivotally supported, by means of a third pivot shaft 18, on the support brackets 17 which are in turn secured to the lower end of the base frame 2. The swing plate 15 is thus capable of tilting motion with its center of tilting motion located at the third pivot shaft 18.

Figure 4:
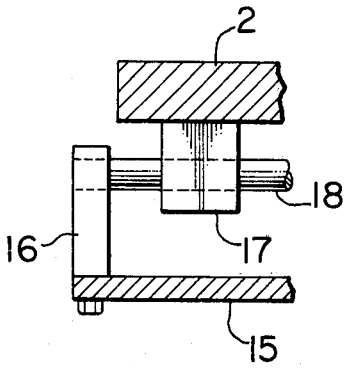
FIG. 4 is a cross sectional view taken along line IV—IV of FIG. 1.

This swing plate 15 is normally biased forwardly by a pair of compression springs 19 whose other ends are secured to the base frame 2. And FIG. 4 shows how the support arms 16 are secured to the rear surface of the swing plate 15 and are pivoted on the mounting bracket 17 secured to the lower end of the base frame 2 through the third pivot shaft 18.

A plurality of solenoids 20*a*, 20*b*, 20*c* and 20*d* are mounted on the rear surface of the swing plate 15 each opposing the projection 13 of the corresponding selector 11. In the state shown in FIG. 2, each of the solenoids 20*a*, 20*b*, 20*c* and 20*d* is in close contact with the corresponding projection 13*a*, 13*b*, 13*c* or 13*d* of the selector 11*a*, 11*b*, 11*c* or 11*d*. Additionally, a transmission arm 21 extends rearwardly from an upper portion of the right side end of the swing plate 15 and the rearmost end of the transmission arm 21 is formed as a downwardly bent piece 22.

Figure 6:
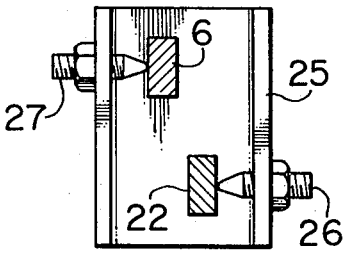
FIG. 6 is a cross sectional view taken along line VI—VI of FIG. 5.

As clearly shown in FIG. 2, a swing lever 24 extending substantially upwardly and termnating at two-pronged ends 25 is securely mounted on a drive shaft 23 which is in turn connected to a drive means which is not shown in the drawing. The two-pronged ends 25 of the swing lever 24 are provided with a first adjust screw 26 threaded into the front end of the two-pronged ends and a second adjust screw 27 threaded into the rear end of the two-pronged ends, respectively. As shown in FIG. 6, these two adjust screws 26 and 27 are laterally offset from one another with their free ends opposing each other along a pair of parallel lines.

The swing lever 24 shown in FIG. 2 is at its most rearwardly swung state and the free end of the first adjust screw 26 is engaged to the front surface of the downwardly bent piece 22 of the transmission arm 21 while the free end of the second adjust screw 27 is disengaged from the rear surface of the lower end of the vertical lever 6 leaving a gap therebetween. And, the vertical lever 6 is biased rearwardly by a tensile spring 28 whose one end is secured to a mid portion of the vertical lever while its other end is secured to a fixed machine frame, and is engaged to a stopper 29 which determines the most rearwardly swung position of the vertical lever 6. In this state, the second pivot axis 8 is located at its lowermost position. And the swing plate 15 is tilted to its rearmost position and the solenoids 20*a*, 20*b*, 20*c* and 20*d* mounted thereon are engaged to the opposing protrusions 13*a*, 13*b*, 13*c* and 13*d* of the selectors 11*a*, 11*b*, 11*c* and 11*d* in close contact.

When the automatic knitting needle selection device described above is activated from the state shown in FIG. 2, first of all, a solenoid 20*a*, for instance, corresponding to the protrusion 13*a* of the selector 11*a* is energized according to a knitting pattern signal obtained by photoelectrically scanning a knitting pattern design. The selector 11*a* is adapted to push up the knitting solenoid 14 located immediately thereabove.

Almost simultaneously, the lever 24 starts swinging forwardly along with the front end of the first adjust screw 26 engaging to the downwardly bent piece 22 of the transmission plate 21 and the swing plate 15 tilts forward with the selector 11*a* attached to the solenoid 20*a*, leaving other selectors 11*b*, 11*c* and 11*d* at their original positions.

In the meantime, the second adjust screw 27 approaches the vertical lever 6 and comes into contact therewith.

As the swing lever swings further forward and the swing plate 15 also tilts further forward, carrying the selector 11*a* therewith away from the selector bed 13, the second adjust screw 27 advances forwardly to push the vertical lever 6 forwardly thereby pushing up the selectors 11*b*, 11*c* and 11*d*, other than the selector 11*a* which is put out of action by being attached to the swing plate 15, by way of the horizontal arms 5 and the elevator arms 7, with a result that the knitting needles corresponding to the selectors 11*b*, 11*c* and 11*d*, that are not attached to the solenoids 20*a* on the swing plate 15, are pushed up to the knitting position. Then the swing lever 24 reaches the most forwardly swung position.

Figure 5:
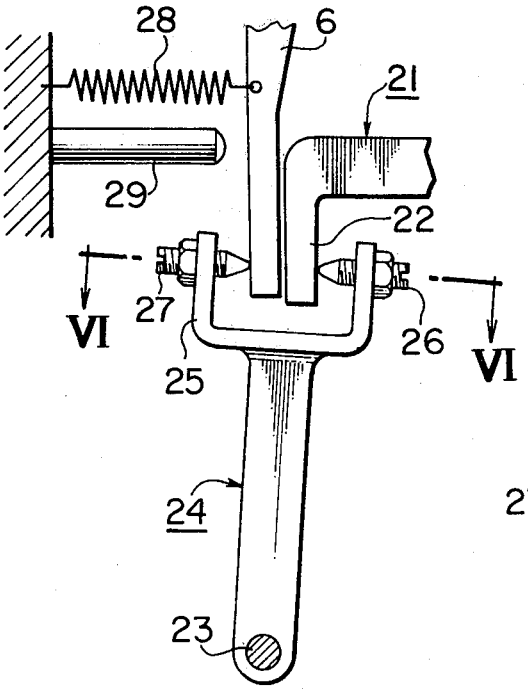
FIG. 5 shows a part of FIG. 1 when needle selection is just completed.

FIG. 5 shows the swing arm 24 when it is in the most forwardly swung position. And, from the drawing, it can also be seen that the vertical lever 6 is tilted to its most forwardly tilted position or furthest away from the stopper 29 while the transmission arm 21 is allowed to be most forwardly tilted by way of the downwardly bent piece 22 which is stopped by the free end of the first adjust screw 26.

Thereafter, according to the pattern signal, the swing lever 24 starts swinging rearwardly and the first adjust screw 26 starts pushing the downwardly bent piece 22 of the transmission plate 21 rearwardly with a result that the swing plate 15 starts tilting rearwardly against the force of the compression coil springs 19. At the same time, the second screw 27 starts moving rearwardly with a result that the vertical lever 6 starts swinging rearwardly thereby moving the second pivot shaft 8 downwardly under the biasing force of the tensile spring 28.

As the swing motion of the vertical lever 6 is terminated by the stopper 29, the second pivot shaft 8 as well as the selectors 11 reach their lowermost positions. At this moment there is a small gap between the selectors 11 and the solenoids 20 so as not to obstruct the downward motion of the selectors 11.

As the swing lever 24 swings further rearwardly, the swing plate 15 alone keeps tilting rearwardly causing the selectors 11 and the solenoids 20 to make close contact with one another and the vertical arm 6 is prevented from any further rearward motion by the stopper 29.

Then, the solenoid 20*a* which has been previously energized is deenergized anew. And, the automatic knitting needle selection device returns to the original state shown in FIG. 2. And, the procedure described above is repeated for a desired number of times for obtaining a desired knitting pattern.

The automatic knitting needle selection device according to this invention is thus capable of accomplishing all the advantages of the similar mechanism disclosed in Japanese Patent Application No. 54-28638 (U.S. Pat. No. 4,275,573 issued on June 30, 1981) and offers the additional advantage of securely holding the selectors without the selectors 11 being inadvertently disengaged from the selector bed 3 due to the vibrations of the knitting machine or other reasons. This is made possible by connecting the lower ends of the selectors 11 to the second pivot shaft 8 in such a manner that the selectors 11 can only make tilting motion relative to the second pivot shaft 8.

Although the present invention has been described with respect to its preferred embodiment, it is obvious to a person skilled in the art that there are various possible modifications and replacements within the limit of the doctrine of equivalence. Therefore, it should be understood that the present invention should not be limited by the specific embodiment thereof described above but solely by the appended claims.

What is claimed is:

1. An automatic knitting needle selection device for forming knitting patterns in a knitting machine, comprising:

a plurality of vertically oriented knitting needles which can assume either a knit position or a non-knit position, a plurality of vertically oriented selectors, provided in one-to-one relation with respect to the knitting needles and pivoted at their lower ends by a pivot shaft, which can assume either a first position adapted for moving the corresponding knitting needles from the non-knit position to the knit position and a second position adapted for not moving the corresponding knitting needles from the non-knit position to the knit position, a plurality of solenoids, again provided in one-to-one relation relative to the selectors, for attracting a selected group from the selectors according to a desired knitting pattern, a first drive means for moving the selectors other than those in the selected group from the first position to the second position, and a second drive means for moving the selectors other than those belonging to the selected group so as to move the corresponding knitting needles from the non-knit position to the knit position.

2. A device according to claim 1, wherein the pivot shaft connected to the lower ends of the selectors is guided by a pair of substantially vertical slots.

3. A device according to claim 2, wherein the first drive means comprises a swing plate, on which the solenoids are mounting in an opposing manner relative to the corresponding selectors, which can tilt for moving the non-selected group of solenoids from the first position to the second position.

4. A device according to claim 3, wherein a protrusion is provided on each of the selectors in such a manner that the protrusions of the selectors are staggered relative to the adjacent ones and the solenoids are mounted on the swing plate so as to oppose the corresponding protrusions of the selectors.

5. A device according to claim 4, wherein the swing plate can be tilted rearwardly until the solenoids substantially contact the corresponding protrusions of the selectors placed in the first position and can be tilted forwardly so that the selectors corresponding to the energized solenoids can be moved from the first position to the second position.

6. A device according to claim 5, wherein the second drive means is connected to the pivot shaft which is provided at the lower ends of the selectors for lifting the selectors remaining in the first position so as to push the corresponding knitting needles to the knit position.

7. A device according to claim 6, wherein the first and the second drive means are operatively synchronized one another so that each cycle of the tilting motion of the swing plate occurs alternatingly with each cycle of the vertical motion of the selectors for moving the corresponding knitting needles to the knit position.

8. A device according to claim 7, wherein the selectors are normally biased toward the first position under the force of gravity.

9. A device according to claim 8, wherein the swing plate is normally biased forward so as to put the selectors, attracted by the corresponding solenoids, to the second position by at least one compression spring.

10. A device according to claim 9, wherein the selectors are normally biased downward by a tensile spring so as to put the corresponding needles to the non-knit position.

11. The device according to claim 10, wherein the synchronized motions of the first and the second drive means are produced by a two-pronged swing arm which repeats a swaying motion over a certain angle.

12. A device according to claim 11, wherein the two-pronged swing arm is provided with adjust screws for adjusting the timing between the motions of the first and the second drive means.

* * * * *